United States Patent [19]

Jordan et al.

[11] 4,115,086

[45] Sep. 19, 1978

[54] RECOVERY OF LIGHT HYDROCARBONS FROM REFINERY GAS

[75] Inventors: Charles H. Jordan, Houston, Tex.; Ajit Sampat, London, England

[73] Assignee: Fluor Corporation, Los Angeles, Calif.

[21] Appl. No.: 642,902

[22] Filed: Dec. 22, 1975

[51] Int. Cl.[2] ..... F25J 3/02

[52] U.S. Cl. ..... 62/28; 62/39; 208/351; 62/18

[58] Field of Search ..... 208/351; 62/23, 27, 62/28, 38, 39

[56] References Cited

U.S. PATENT DOCUMENTS

| | | | |
|---|---|---|---|
| 2,500,353 | 3/1950 | Gantt | 62/28 |
| 2,596,785 | 5/1952 | Nelly, Jr. | 62/28 |
| 2,777,305 | 1/1957 | Davison | 62/28 |
| 3,073,129 | 1/1963 | Grenier | 62/28 |
| 3,555,836 | 1/1971 | Schramm | 62/27 |

*Primary Examiner*—Norman Yudkoff

*Attorney, Agent, or Firm*—Lyon & Lyon

[57] ABSTRACT

Described herein is a process for the recovery of light hydrocarbons from refinery gas by an expansion-distillation process. The refinery gas is compressed and cooled in a series of steps to liquify and remove light hydrocarbons from the refinery gas. The vapor portion remaining, comprised of methane, is expansively cooled thereby performing useful work. The expansively cooled vapor is used as a heat exchange medium for cooling the process stream. The liquified light hydrocarbons are separated by distillation.

6 Claims, 2 Drawing Figures

RECOVERY OF LIGHT HYDROCARBONS FROM REFINERY GAS

FIELD OF THE INVENTION

This invention relates to a method for treating a refinery gas stream. More specifically, this invention relates to a process for recovering light hydrocarbons from a refinery gas stream.

BACKGROUND OF THE INVENTION

Light hydrocarbons, which broadly speaking include ethane, propane, butanes and their unsaturated analogs such as ethylene, propylene, and butene-1, for the most part are obtained from two major sources. Those sources are streams of either natural gas or refinery gas. The latter is usually obtained as a by-product of a high temperature process such as cracking or coking. As a result, a refinery gas stream is typically a more complex mixture of products than is a natural gas stream. For example, in addition to simple unsaturated compounds such as ethylene or propylene which are not normally found in significant amounts in natural gas, refinery gas may further contain diolefins and acetylenes. Typical refinery gas streams may also contain more compounds of nitrogen and sulfur and more heavy hydrocarbons (pentanes and higher) than typical streams of natural gas.

Two types of processes, absorption and distillation, have been employed to recover light hydrocarbons from streams of natural gas in which they are found. The absorption process, which is carried out at relatively high pressures and temperatures, has been adapted for use with refinery gas streams as well. However, this process has one significant drawback, in that very little light hydrocarbons of two carbon atoms, for example ethane and ethylene, are recovered by its use.

The distillation process allows for separation of light hydrocarbons including those of two carbon atoms. Since the boiling points of light hydrocarbons are at relatively low temperatures, a distillation process of necessity must be carried out at low temperatures. Attainment of the requisite low temperature has been made economical by the development of reliable turbo expanders. Using these expanders, the temperature of a gas stream at relatively high pressure can be lowered substantially by expansive cooling. Use of such expanders is economical not only because of the expansive (Joule-Thompson) effect but also because the energy equivalent of useful work can be extracted from the gas.

The combination of gas expansion with utilization of useful work and a low temperature distillation, is ideally suited for the recovery of light hydrocarbons from natural gas streams since such streams are normally available at high pressure and ambient temperature. In fact, it has become the preferred method for recovering light hydrocarbons from a natural gas stream because the expansion-distillation process is not only more efficient but also requires a lower capital investment than does an absorption plant.

Notwithstanding the fact that the distillation process is more efficient, heretofore, the recovery of light hydrocarbons from refinery gas has been exclusively by the absorption process. The reason for this has been that refinery gas is usually available at a relatively low pressure, typically atmospheric or slightly above and at a temperature usually above ambient. Therefore, even though the distillation process is the more efficient one, the requirement that the feed stream be compressed to a high pressure and pre-cooled to a point that a turbo expansion step will achieve the desired low temperature has made it economically impractical to employ the process for the recovery of light hydrocarbons from refinery gas.

SUMMARY OF THE INVENTION

According to the present invention, an improved expansion-distillation process is provided that makes it economically practical to recover light hydrocarbons from refinery gas by distillation.

The improved expansion-distillation process of this invention comprises compressing and cooling a feed stream of refinery gas to liquify substantially all the $C_5$ and higher hydrocarbons, if any, and a major portion of the $C_4$ hydrocarbons. When this is done, a large portion of the $C_3$ hydrocarbons and small amounts of the other hydrocarbon constituents of the feed stream are also liquified. The vapor phase remaining is comprised of substantially all of the methane and a major portion of the ethane in the feed stream. The phases are separated and the vapor phase is further cooled to liquify a major portion of the remaining $C_2$ and higher hydrocarbons. After these phases are separated, the vapor portion is expansively cooled to produce a small amount of liquid comprised of methane and higher hydrocarbons. This liquid portion is separated from the vapor and combined with the other liquid fractions from the previous cooling steps. The combined liquid portions are distilled to remove the light hydrocarbons. In the process of expansive cooling, useful work is obtained from the expansion operation. The vapor and liquid portions can be used as heat exchange media.

It is an object of this invention to provide an economical process for recovering light hydrocarbons from refinery gas. It is another object of this invention to provide a process for the recovery of light hydrocarbons from refinery gas that is more efficient than the absorption process.

BRIEF DESCRIPTION OF THE DRAWINGS

FIG. I is a schematic diagram of one embodiment of this invention.

FIG. II is a schematic diagram of another embodiment of this invention.

DESCRIPTION OF THE PREFERRED EMBODIMENTS

Figure 1:
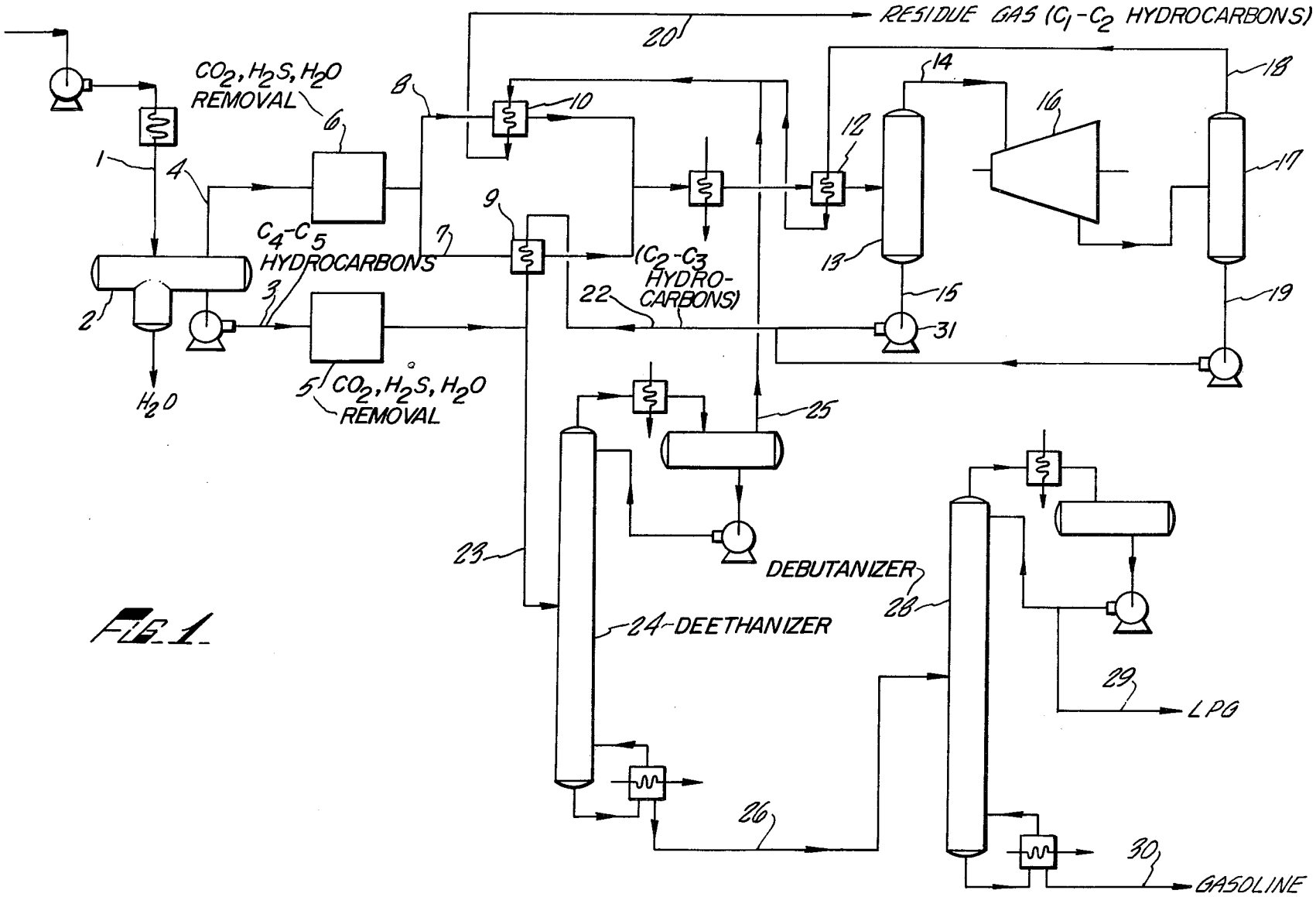
Figure 2:
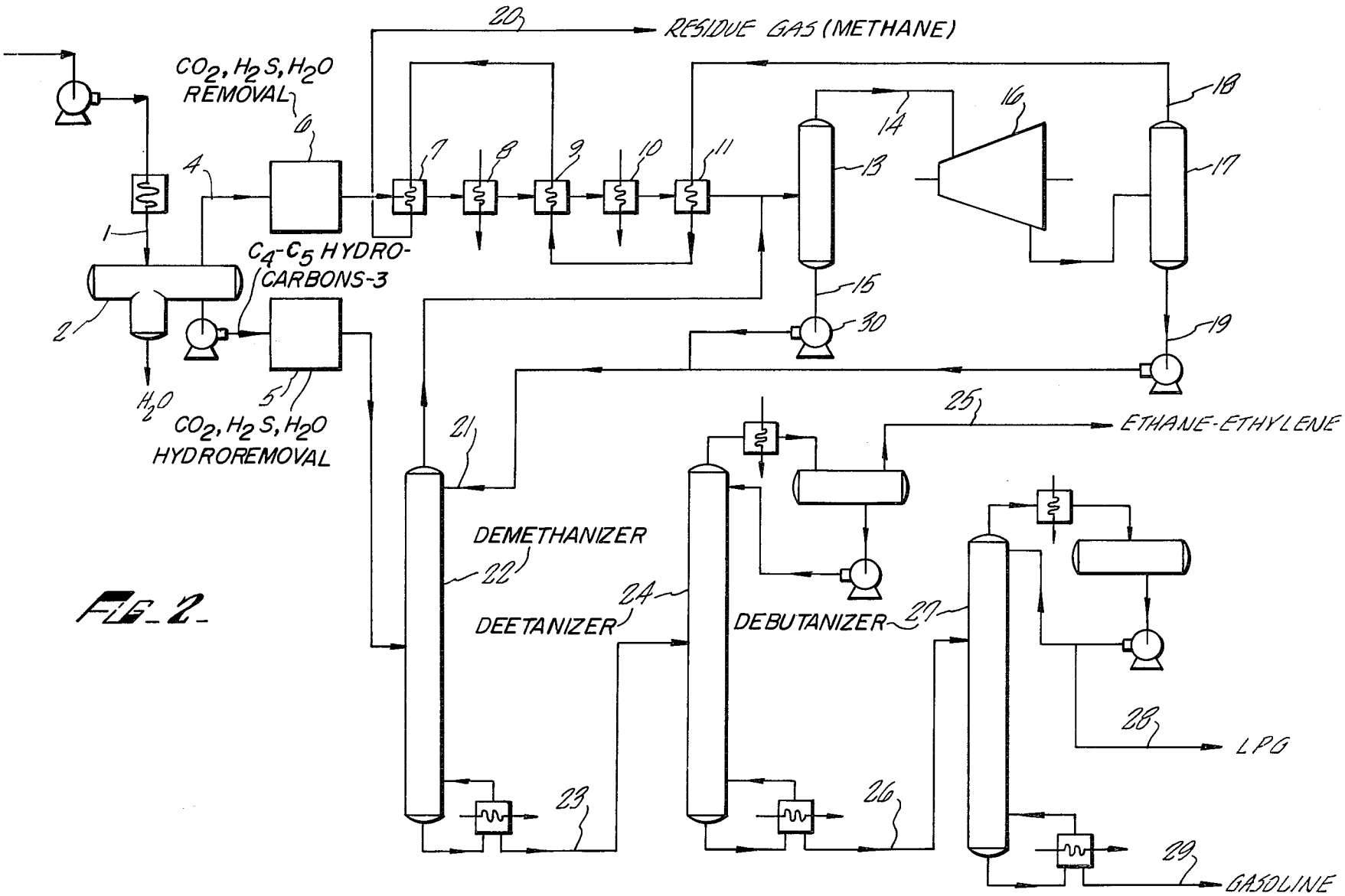

According to the present invention, a stream of refinery gas comprised of methane and significant quantities of light hydrocarbons ($C_2$–$C_4$ hydrocarbons) contaminated by hydrogen, inert gases, acidic impurities such as $H_2S$ or $CO_2$, water and quantities of $C_5$ and heavier hydrocarbons are processed to recover light hydrocarbons.

The feed stream of refinery gas is first compressed and cooled to liquify substantially all the $C_5$ hydrocarbons. When this is done, a major portion of the $C_4$ hydrocarbons and a large portion of the $C_3$ hydrocarbons also liquify. The combination of temperature and pressure necessary to obtain this result can vary according to the composition of the feed stream. For a typical stream of refinery gas, this can be accomplished by compressing the gas to at least about 300 p.s.i.g. and cooling it to about 100° F by conventional means. Preferably the gas is compressed and cooled to an extent that the major portion of the $C_3$ hydrocarbons and a substantial portion of the $C_2$ hydrocarbons are liquified. Typically, for a gas cooled to about 100° F, this result can be accomplished by compressing it to about 450 p.s.i.g.

It is not unusual for refinery gas to contain some water. If a significant amount of water is present in the refinery gas, it may be removed prior to compression and cooling. However, if this is not done, substantially all the water will separate as yet another liquid phase as a result of the compression and cooling process and can be conveniently removed at this point.

After compression and cooling, the liquid and vapor phases are separated and treated by conventional means to remove any remaining water and acidic impurities such as $CO_2$ and $H_2S$. Optionally, these impurities can be removed prior to the cooling and compression step. After the removal of acidic impurities has been accomplished, the vapor phase is further cooled to liquify a portion of the remaining hydrocarbons. By this step, additional amounts of light hydrocarbons remaining in the vapor phase, including a major portion of the $C_2$ hydrocarbons, as well as considerable methane, are liquified. The removal of $C_2$ hydrocarbons can be accomplished over a range of temperatures and pressures. For a stream at about 300 p.s.i.g., or greater, a temperature of about −40° F will be satisfactory. Preferably, a temperature of about −70° F and a pressure of about 450 p.s.i.g. is employed.

After separation of the liquid phase, the vapor portion is expansively cooled to at least about −120° F, preferably about −150° F, using a turbo expander. Operation of the expander generates useful work which can be employed in a variety of ways within the process. For example, it can be used to drive centrifugal pumps or compressors used in the process.

The cooling by expansion normally liquifies a small portion of the vapor stream. This liquid portion is comprised, in the main, of small amounts of light hydrocarbons present in the vapor stream prior to expansion. This liquid portion and those of the other cooling steps are combined and distilled to separate light hydrocarbons. The cooled vapor stream comprises the residue product gas, chiefly methane, and is passed in a heat exchange relationship with the feed gas or other stream involved in the process.

With reference now to FIGS. I and II, particular processes for carrying out this invention are described.

EXAMPLE I

FIG. 1 shows a flow diagram for a light hydrocarbon recovery system as used for this example. Table I shows compositions, temperatures, and pressures of various streams. A refinery stream 1 is compressed and cooled by conventional means (not shown) to 335 p.s.i.g. and 100° F. After compression and cooling, the stream is separated in drum 2 into a first liquid stream 3 and a first vapor stream 4. Water that separates as a discrete liquid phase can be drawn off from drum 2 as shown. These two streams are processed in a conventional manner in separate treating and dehydration zones 5 and 6 to remove substantially all of the $CO_2$, $H_2S$ and $H_2O$ present.

After treating and dehydration, vapor stream 4 is divided into streams 7 and 8 for cooling by indirect heat exchange in exchangers 9 and 10, after which the stream is combined for further cooling by indirect heat exchange against a −35° F refrigerant stream in exchanger 11 and in 12 against residue gas entering at a temperature of −123° F. The stream leaving exchanger 12 is partially condensed and flows to drum 13 for separation into a second vapor stream 14 and a second liquid stream 15.

Vapor stream 14 is conducted to expander 16 wherein the pressure is reduced to 65 p.s.i.g. while doing useful work, for example, by driving a centrifugal pump or compressor such as pump 31.

TABLE 1

STREAM COMPOSITIONS, TEMPERATURES, PRESSURES

| STREAM | 1 | 3 | 4 | 14 | 15 | 18 | 19 | 20 | 23 | 25 | 26 | 29 | 30 |
|---|---|---|---|---|---|---|---|---|---|---|---|---|---|
| COMPONENT | Pound-Mols per Hour | | | | | | | | | | | | |
| H | 628.9 | 11.2 | 617.7 | 611.6 | 6.1 | 611.6 | — | 628.9 | 17.3 | 17.3 | — | — | — |
| inert gas | 438.6 | 17.3 | 421.3 | 406.0 | 15.3 | 405.8 | 0.2 | 438.6 | 32.8 | 32.8 | — | — | — |
| $CH_4$ | 1136.6 | 107.3 | 1029.3 | 871.4 | 157.9 | 867.1 | 4.3 | 1136.6 | 269.5 | 269.5 | — | — | — |
| $C_2H_4$ | 227.9 | 53.0 | 174.9 | 86.9 | 88.0 | 81.6 | 5.3 | 227.9 | 146.2 | 146.2 | — | — | — |
| $C_2H_6$ | 513.0 | 147.3 | 365.7 | 135.6 | 230.1 | 119.9 | 15.7 | 511.0 | 393.1 | 391.1 | 2.0 | 2.0 | — |
| $CO_2$ | 51.8 | 9.6 | 42.2 | — | — | — | — | — | — | — | — | — | — |
| $H_2S$ | 583.9 | 128.4 | 255.5 | — | — | — | — | — | — | — | — | — | — |
| $C_3H_6$ | 823.3 | 414.4 | 409.1 | 47.7 | 361.4 | 24.2 | 23.5 | 33.0 | 799.1 | 8.8 | 790.3 | 790.3 | — |
| $C_3H_8$ | 312.9 | 167.9 | 145.0 | 14.1 | 130.9 | 6.2 | 7.9 | 6.7 | 306.7 | 0.5 | 306.2 | 306.2 | — |
| i-$C_4H_{10}$ | 444.0 | 319.1 | 124.9 | 4.3 | 120.6 | 0.7 | 3.6 | 0.7 | 443.3 | — | 443.3 | 438.9 | 4.4 |
| $C_4H_8$ | 602.8 | 448.6 | 154.2 | 4.2 | 150.0 | 0.5 | 3.7 | 0.5 | 602.3 | — | 602.3 | 593.0 | 9.3 |
| n-$C_4H_{10}$ | 108.6 | 84.0 | 24.6 | 0.5 | 24.1 | 0.1 | 0.5 | 0.1 | 108.5 | — | 108.5 | 103.4 | 5.1 |
| n-$C_5H_{12}$ | 589.8 | 513.9 | 57.9 | 0.3 | 57.6 | — | 0.3 | — | 589.8 | — | 589.8 | 28.8 | 561.0 |
| $C_6H_{14}$& HVYR | 313.9 | 301.9 | 12.0 | — | 12.0 | — | — | — | 313.9 | — | 313.9 | — | 313.9 |
| $H_2O$ | 185.7 | 1.5 | 12.7 | — | — | — | — | — | — | — | — | — | — |
| TOTAL | 6761.7 | 2743.2 | 3847.0 | 2182.6 | 1354.0 | 2117.7 | 65.0 | 2984.0 | 4022.5 | 866.2 | 3156.3 | 2262.6 | 893.7 |
| STREAM | 1 | 3 | 4 | 14 | 15 | 18 | 19 | 20 | 23 | 25 | 26 | 29 | 30 |
| COMPONENT | Pound-Mils per Hour | | | | | | | | | | | | |
| TEM. −° F | 100 | 100 | 100 | −45 | −45 | −123 | −123 | 90 | 102 | 5 | 218 | 120 | 347 |
| PRESS-psig | 335 | 450 | 335 | 320 | 320 | 65 | 65 | 50 | 430 | 427 | 435 | 165 | 175 |

The temperature at the outlet of the expander is −123° F and some of the vapor has condensed. The vapor-liquid mixture is separated in drum 17 into a third vapor stream 18 and a third liquid stream 19. The vapor stream 18 is warmed in exchanger 12, is combined with deethanizer overhead stream 25 to be described later, and the combined stream is further rewarmed in exchanger 10 and becomes the residue gas product stream 20.

The liquid stream 19 is combined with the second liquid stream 15 and the combined stream 22 is warmed in exchanger 9 after which it is combined with first liquid stream 3 (after treating and dehydration) thus forming feed stream 23 to the deethanizer 24, which is a conventional distillation column having the overhead stream 25 previously mentioned. The bottom stream 26 from the deethanizer is fed to debutanizer column 28 which is a second conventional distillation column having an overhead stream 29, which is a product stream comprised of light hydrocarbons having three and four hydrocarbons (LPG) and a bottom stream 30 which is cooled in exchanger 27 and becomes a gasoline blending stock.

As can be calculated from the material balance shown in Table I, the following recoveries of light hydrocarbons from the refinery stream have been achieved:

| | % | Pounds Per Day |
|---|---|---|
| $C_3H_6$ | 96 | 795,000 |
| $C_3H_8$ | 98 | 324,000 |
| | | 1,119,000 |

In a comparison made between the distillation process of Example I and a modern absorption plant capable of a similar recovery of light hydrocarbons, it is found that:

1. Plant investment is higher for the absorption plant by about $1,500,000.
2. Operating costs are higher for the absorption plant by about $300,000 per year.

EXAMPLE II

FIG. II shows a flow diagram for a light hydrocarbon recovery system as used for this example. Table II shows composition, temperatures, and pressures of various streams. In Example 2, the same refinery stream treated in Example 1 is treated by an expander/distillation process in which a substantial additional portion of the light hydrocarbons is recovered, the major portion of the additional material being light hydrocarbons containing two carbon atoms. Such recovery has not been commercially attained heretofore from refinery streams by the absorption process.

The flow is identical with Example 1 through treating and dehydration zones 5 and 6, except that in this Example, the pressure is higher (485 p.s.i.g.) at this point. After removal of $CO_2$, $H_2S$ and $H_2O$ in zone 5, first the vapor stream 4 is cooled by indirect heat exchange in a series of heat exchangers 7, 8, 9, 10 and 11, thereby condensing part of the vapor.

The effluent from exchanger 11 is mixed with demethanizer overhead stream 12, the source of which will be described later. The mixture passes to drum 13 for separation into second vapor stream 14 and second liquid stream 15. The second vapor stream flows to expander 16 wherein the pressure is reduced to 85 p.s.i.g. doing useful work, for example by driving pump 30. The temperature at the outlet of the expander is −157° F and some of the vapor has condensed. The vapor-liquid mixture is separated in drum 17 into a third vapor stream 18 and a third liquid stream 19.

The third vapor stream is warmed in exchangers 11, 9 and 7 and becomes the residue gas product stream 20. The liquid stream 19 is combined with second liquid stream 15 and the mixture becomes reflux stream 21 to demethanizer column 22.

First liquid stream 3 (after treating and dehydration) becomes feed to the demethanizer distillation column 22. Demethanizer overhead stream 12 is combined with exchanger 11 effluent as described above. Demethanizer bottom stream 23 becomes feed to deethanizer distillation column 24. Overhead from column 24 is ethane-ethylene product stream 25. Column 24 bottom becomes debutanizer column feed stream 26. Overhead from column 27 is LPG product stream 28 and bottom stream 29 is gasoline blending stock.

As can be calculated from the material balance shown in Table 2, the following recoveries have been achieved:

| | % | Pounds Per Day |
|---|---|---|
| $C_2H_4$ | 76 | 116,500 |
| $C_2H_6$ | 88 | 325,000 |
| $C_3H_6$ | 98.3 | 815,000 |
| $C_3H_8$ | 99.5 | 328,000 |
| | | 1,584,500 |

Investment and operating costs for the plant of Example 2 are substantially the same as for an absorption plant having the recoveries attained in Example 1. Thus the additional recovery of 465,500 pounds per day of valuable product not recoverable in an absorption plant is obtained with no increase in cost.

While certain embodiments in application of this invention have been shown and described, it would be apparent to those skilled in the art that modifications of these are possible within the scope of the concept of this invention.

We claim:

TABLE 2

| STREAM COMPOSITIONS, TEMPERATURES, PRESSURES | | | | | | | | | | | | | | |
|---|---|---|---|---|---|---|---|---|---|---|---|---|---|---|
| STREAM | 1 | 3 | 4 | 14 | 15 | 20 | 19 | 21 | 12 | 23 | 25 | 26 | 28 | 29 |
| COMPONENT | Pound-Mols per Hour | | | | | | | | | | | | | |
| $H_2$ | 628.9 | 23.0 | 605.9 | 629.0 | 7.4 | 629.0 | 0.1 | 7.5 | 30.5 | — | — | — | — | — |
| inert gas | 438.6 | 33.8 | 404.8 | 439.4 | 21.9 | 438.8 | 0.6 | 22.5 | 56.6 | — | — | — | — | — |
| $CH_4$ | 1136.6 | 194.0 | 942.6 | 1135.3 | 295.4 | 1122.9 | 12.5 | 307.9 | 488.2 | 13.7 | 13.7 | — | — | — |
| $C_2H_4$ | 227.9 | 83.0 | 144.9 | 65.7 | 104.3 | 54.3 | 11.4 | 115.7 | 25.1 | 173.6 | 173.5 | 0.1 | 0.1 | — |
| $C_2H_6$ | 513.0 | 220.3 | 292.7 | 87.5 | 239.0 | 59.8 | 27.7 | 266.7 | 33.8 | 453.2 | 451.1 | 2.1 | 2.1 | — |
| $CO_2$ | 51.8 | 16.2 | 35.6 | — | — | — | — | — | — | — | — | — | — | — |
| $H_2S$ | 383.9 | 185.3 | 198.6 | — | — | — | — | — | — | — | — | — | — | — |
| $C_3H_6$ | 823.3 | 533.0 | 290.3 | 21.7 | 277.8 | 4.2 | 17.5 | 295.3 | 9.2 | 819.1 | 10.1 | 809.0 | 809.0 | — |
| $C_3H_8$ | 312.9 | 211.4 | 101.5 | 6.3 | 97.9 | 1.0 | 5.3 | 103.2 | 2.7 | 312.0 | 0.6 | 311.4 | 311.4 | — |
| i-$C_4H_{10}$ | 444.0 | 362.5 | 81.5 | 1.7 | 80.6 | 0.1 | 1.7 | 82.3 | 0.8 | 443.9 | — | 443.9 | 439.5 | 4.4 |
| $C_4H_8$ | 602.8 | 503.7 | 99.1 | 1.6 | 98.3 | — | 1.5 | 99.8 | 0.8 | 602.8 | — | 602.8 | 594.0 | 8.8 |
| n-$C_4H_{10}$ | 108.6 | 92.9 | 15.7 | 0.2 | 15.6 | — | 0.2 | 15.8 | 0.1 | 108.6 | — | 108.6 | 103.5 | 5.1 |
| n-$C_5H_{12}$ | 589.8 | 553.8 | 36.0 | 0.1 | 36.0 | — | 0.1 | 36.1 | 0.1 | 589.8 | — | 589.8 | 2.9 | 586.9 |
| $C_6H_{14}$&HVYR | 313.9 | 306.4 | 7.5 | — | 7.5 | — | — | 7.5 | — | 313.9 | — | 313.9 | — | 313.9 |
| $H_2O$ | 185.7 | 1.8 | 8.0 | — | — | — | — | — | — | — | — | — | — | — |
| TOTAL | 6761.7 | 3321.1 | 3264.7 | 2388.5 | 1281.7 | 2310.1 | 78.6 | 1360.3 | 647.9 | 3830.6 | 649.0 | 3181.6 | 2262.5 | 919.1 |
| TEMP. −° F | 100 | 100 | 100 | −70 | −70 | 90 | −157 | −75 | −46 | 171 | 40 | 219 | 120 | 347 |
| PRESS-psig | 485 | 530 | 485 | 465 | 465 | 60 | 85 | 525 | 525 | 535 | 420 | 435 | 160 | 175 |

1. A process for the recovery of light hydrocarbons from a feed stream of refinery gas comprised of methane and said light hydrocarbons comprising:

(a) compressing and cooling the stream to liquify substantially all $C_5$ and higher hydrocarbons and a major portion of the $C_4$ hydrocarbons present in the stream;

(b) separating as a vapor phase the unliquified portion of the stream from the liquid portion;

(c) cooling the vapor phase to liquify a major portion of the $C_2$ hydrocarbons present in the vapor phase;

(d) separating the vapor from the liquid portion and expansively cooling the vapor to at least about −120° F;

(e) separating any liquid formed by the expansion from the vapor;

(f) combining the liquified portions of the feed stream;

(g) separating the methane from said combined liquid portion as a vapor and adding said methane vapor to said vapor phase prior to expansively cooling said vapor phase;

(h) separating the $C_2$ hydrocarbons from said combined liquid portions at a pressure above that of said vapor phase; and (i) distilling the remainder of said combined liquid portions to separate light hydrocarbon fractions.

2. A process according to claim 1 wherein the feed is compressed to at least about 300 p.s.i.g. and cooled to about 100° F.

3. A process according to claim 2 wherein the vapor phase is cooled to about −40° F before expansion.

4. A process according to claim 1 wherein the feed stream is compressed to about 450 p.s.i.g. and cooled to about 100° F.

5. A process according to claim 4 wherein the vapor phase is cooled to about −70° F prior to expansion.

6. A process according to claim 5 wherein the vapor phase is cooled to about −150° F in the expansion step.

* * * * *